US009898765B1

(12) United States Patent
Jones, II et al.

(10) Patent No.: US 9,898,765 B1
(45) Date of Patent: Feb. 20, 2018

(54) PRICING USAGE OF SOFTWARE PRODUCTS

(71) Applicant: Amazon Technologies, Inc., Reno, NV (US)

(72) Inventors: Thomas Price Jones, II, Santa Cruz, CA (US); Brian M. Matsubara, II, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/500,717

(22) Filed: Sep. 29, 2014

(51) Int. Cl.
*G06Q 30/04* (2012.01)

(52) U.S. Cl.
CPC ..... *G06Q 30/04* (2013.01)

(58) Field of Classification Search
None
See application file for complete search history.

(56) References Cited

U.S. PATENT DOCUMENTS

2007/0271162 A1* 11/2007 Shuster ..... G06Q 30/04 705/34
2013/0006673 A1* 1/2013 Hurston ..... G06Q 30/04 705/4

* cited by examiner

*Primary Examiner* — Shay S Glass
(74) *Attorney, Agent, or Firm* — Lee & Hayes, PLLC; Charles L. Warner

(57) ABSTRACT

Functionality is disclosed herein for charging for the use of software products based upon billable units defined by a software provider. The software product identifies the occurrences of the billable units as the software product is executing. The software product also sends billing data to a billing service identifying an occurrence of a billable unit, or billable units, such that an invoice may be created that charges for use of the software product based, at least in part, on the occurrence of the billable units.

20 Claims, 9 Drawing Sheets

PRICING USAGE OF SOFTWARE PRODUCTS

BACKGROUND

In many cases, software products are sold or licensed to customers. For example, a software provider might either sell a software product for a fixed price or sell a subscription to use the software product. In some cases, a license might be purchased that allows the customer to use the software product for some duration of time (e.g., six months or one year). In other cases, a subscription might be purchased that charges for use of the software product based on the amount of time that the software product is executed. For instance, customers may be charged an amount that is based upon the amount of time that the software product executes within a service provider network. In some cases, however, charging customers based on the amount of time a software product is executed might not represent the actual value provided by the execution of the software product.

The disclosure made herein is presented with respect to these and other considerations.

DETAILED DESCRIPTION

Figure 1:
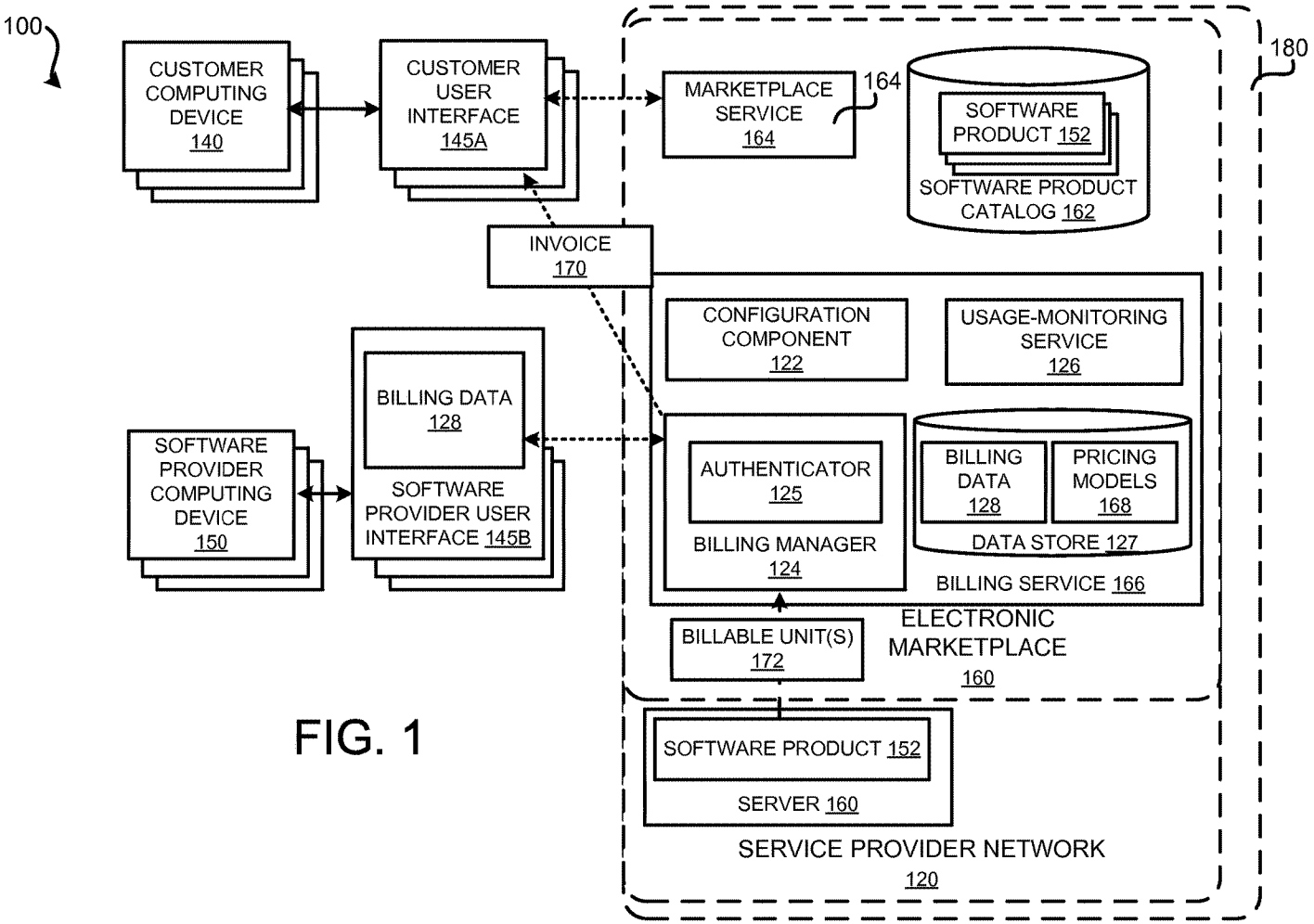
FIG. 1 is a block diagram depicting an illustrative operating environment in which the use of a software product is priced based on billable units defined by a provider of the software product.

The following detailed description is directed to technologies for pricing the use of a software product based on billable units defined by the provider of the software product. Using the technologies described herein, a software provider might define one or more billable units that are used to determine charges for use of a software product. Instead of being limited to a pricing model that is time bound, the software provider may specify other criteria that are used to determine how to charge for the use of the software product. As used herein, the term "billable unit" may refer to a discrete unit that relates to a use of the software product. The term "software product" may refer to software and/or software services. For example, a software product may be an application, a machine image, or software as a service ("SaaS"). In some examples, the software product may be available from an electronic marketplace and may be executed in a service provider network.

Generally, a software provider may define billable units that value the use of the software product. The billable units that are defined may be based on almost any type of parameter that is associated with the use of a software product. For example, the billable units might relate to pricing parameters such as, but not limited to a number of operations performed by the software product, functionality provided by the software product, a number of items accessed by the software product, an amount of data processed by the software product, a number of log-ins to the software product, and the like. In some examples, the pricing parameters include non-time bound pricing parameters. In other examples, the pricing parameters might also include time bound pricing parameters (e.g., the amount of time the application is performing certain operations).

A software provider may define one or more billable units that may be used to determine the usage fees for use of a software product. For example, a software provider might define one billable unit that is utilized to charge for the use of the software product. In other examples, the software provider may define a plurality of different billable units that may be utilized to charge for the use of the software product. Each billable unit may be associated with the same fee or a different fee. For example, one rate may be charged for the performance or occurrence of one type of billable unit and another rate may be charged for the performance or occurrence of another type of billable unit.

In some configurations, a software provider defines the billable units and updates the software product to support billing for use of the software product based upon the occurrences of the defined billable units. According to some examples, the software product is configured by the software provider to send billing data to a billing service that may be used to bill for use of the software product. For example, during execution of the software product (e.g., within a service provider network), the software product may send messages including billing data that identifies a number of occurrences of the billable units to a billing service. The messages may specify a number of billable units performed by the software product within a specified time along with the price for the performance of each billable unit. The message may also include data identifying the software product, the software provider, and the customer executing the software product. According to some configurations, a message may be sent to the billing service for each billable unit that is detected or performed by the software product. In other examples, the messages may be sent at other times (e.g., periodically, at specified times, intervals, or in response to some other event).

The billing service may be configured to verify that the billing data associated with the message is valid. For example, credentials of the customer executing the software product may be verified. When the billing data is verified, the pricing information relating to one or more billable units may be stored with other billing data relating to the use of the software product by the customer. The billing data may then be used to generate an invoice for the customer. For example, the billing service might aggregate the billable units over a specified time to create an invoice for the customer.

According to some configurations, the billing service causes an invoice to be generated for the customer that includes charges for the billable units as well as service provider network charges that are associated with the use of computing resources provided by the service provider network. For example, the billing service may charge for use of the computing resources used by the customer during the execution of the software product in the service provider network. In some instances, the software provider may not know any personally identifiable information ("PII") about the customer. Instead, the billing service may associate the billing data with the customer and generate the invoice on behalf of the software provider.

In some examples, the service provider network removes PII from customer data before any customer data is provided to the software provider. In other words, the customer data is anonymized by the service provider network before being provided to a third party software provider. As used herein, the term "anonymized" may refer to removing PII from data. According to some examples, the third party software provider identifies a customer of the service provider network using a unique identifier provided by the service provider network that does not include PII about the customer.

According to some configurations, a software provider might associate different pricing models with the software product. In some cases, a software provider may set different prices for different customers. For example, some customers might be associated with one pricing model whereas other customers may be associated with a different pricing model. According to other configurations, a software provider might dynamically change the pricing of the software product. For example, pricing for an occurrence of a billable unit might be lower during one time of the day and higher during another time. As another example, pricing for an occurrence of a billable unit might be lower when computing resources are readily available and higher when computing resources are scarcer. The pricing models provided by the software provider might be associated with more than one software product. For example, the software provider might charge for rendering a frame using one software product and charge for storing the frame using a different software product. A pricing model might also provide discounts for use of the software product or combination of products.

A billing user interface, such as a graphical user interface ("GUI"), might also provided and made available to a software provider for viewing and interacting with billing data. For example, the billing user interface might be used to specify aspects of the billable units and to view billing data that is associated with one or more software products. In some cases, the billing data includes data relating to the defined billable units as well as other metrics. For example, the billing data might include billable units used to charge for use of the software product, revenue generated by use of the software product, and the like. Additional details regarding the various components and processes described above relating to pricing for use of software products using billable units specified by software providers will be presented below with regard to FIGS. 1-9.

It should be appreciated that the subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, personal digital assistants, e-readers, mobile telephone devices, tablet computing devices, special-purposed hardware devices, network appliances and the like. As mentioned briefly above, the technologies described herein may be practiced in distributed computing environments, where tasks may be performed by remote computing devices that are linked through a communications network. In a distributed computing environment, program modules may be located in both local and remote memory storage devices.

In the following detailed description, references are made to the accompanying drawings that form a part hereof, and that show, by way of illustration, specific technologies or examples. The drawings herein are not drawn to scale. Like numerals represent like elements throughout the several figures (which may be referred to herein as a "FIG." or "FIGS.").

FIG. 1 is a block diagram depicting an illustrative operating environment 100 in which pricing for the use of a software product is based on billable units defined by a provider of the software product. As illustrated in FIG. 1, the operating environment 100 includes one or more customer computing devices 140 and one or more software provider computing devices 150 in communication with an electronic marketplace 160 and a service provider network 120. A third party software provider, or some other software provider, using a software provider computing device 150, may submit one or more software products 152 (e.g., virtual machine images) to the electronic marketplace 160. The electronic marketplace 160 may then make the submitted software product 152, as well as other software products 152 submitted to the electronic marketplace 160, available to customers. As used herein, the terms "customer" and "customers" refer to existing customers of the electronic marketplace 160 as well as visitors (i.e. potential customers) to the electronic marketplace 160.

A customer, using a customer computing device 140, may access the electronic marketplace 160 to browse and acquire the use of software products 152 made available in the electronic marketplace 160 by a software provider, or the operator of the electronic marketplace 160. As used herein, "acquire" the use of the software product may refer to a customer being authorized to execute the software product. For example, the customer may be authorized to execute the software product within the service provider network 120 and/or on another computing device (e.g., the customer computing device 140). In some examples, a customer establishes a subscription to the software product 152 that allows the customer to execute the software product 152 for a specified usage fee.

The specified usage fee may be based on different factors that may be defined, at least in part, by the software provider. As discussed above, the usage fees might be determined from billable unit(s) 172 that are defined by the software provider of the software product 152. Some examples of a billable unit 172 that might be associated with the use of a software product 152 include, but are not limited to a number of operations performed by the software product 152, functionality accessed or performed by the software product 152, a number of items accessed by the software product 152, an amount of data processed by the software product 152, a number of log-ins to use the software product 152, a type of processing performed by the software product 152, a type of resource used by the software product 152, and the like.

After acquiring the software product 152, the customer may configure the software product 152 and launch the software product 152 in a service provider network 120 that is operated, maintained, provided or otherwise associated with the operator of the electronic marketplace 160. In some examples, the service provider network 120 might be operated by a different entity from the electronic marketplace 160. The third party software providers might be customers of the service provider network 120 and/or the electronic marketplace 160.

As described in more detail below, the service provider network 120 may include a collection of rapidly provisioned and, potentially, released computing resources hosted in connection with the marketplace or a third party provider. The computing resources may include a number of computing, networking and storage devices in communication with one another. In some configurations, the computing resources may correspond to physical computing devices. In other configurations, the computing resources may correspond to virtual machine instances implemented by one or more physical computing devices. In still other configurations, computing resources may correspond to both virtual machine instances and physical computing devices. The service provider network 120, or the billing service 166, may charge customers for the use of computing resources.

In the illustrated example, the electronic marketplace 160 is provided by a computing environment including several computer systems that are interconnected using one or more networks. More specifically, the electronic marketplace 160 may be provided by a marketplace service 164 and an electronic software product catalog 162 including software products 152, and a billing service 166. Each of these will be described in more detail below. In this regard, it should be appreciated that the environment configured to provide the electronic marketplace 160 might have fewer or more components than are illustrated in FIG. 1. For example, all or a portion of the components illustrated in the electronic marketplace 160 may be provided by the service provider network 120 as illustrated by a dashed line 180. The electronic marketplace 160 could include various Web services and/or peer-to-peer network configurations. Thus, the depiction of the electronic marketplace 160 in FIG. 1 should be taken as illustrative and not limiting to the present disclosure.

The marketplace service 164 facilitates submission of software products 152 by third party software providers and browsing and acquisition by customers of software products offered through the electronic marketplace 160. Accordingly, a software provider, utilizing a software provider computing device 150 and a software provider user interface 145B, may submit one or more software products 152 to the electronic marketplace 160 via the marketplace service 164. The submitted software products 152 may then be included in an electronic software product catalog 162. According to some configurations, the electronic marketplace 160 and the service provider network 120 are operated and owned independently from the third party software providers that submit the software products 152 for inclusion in the electronic marketplace 160.

The software product catalog 162 includes information on software products 152 submitted from different software providers and, potentially, on software products 152 made available by the operator of the electronic marketplace 160. Accordingly, the marketplace service 164 may obtain software products from software providers and make the software products available to a customer from a single network resource, such as a Web site. A customer may then acquire the software product 152 from the electronic marketplace 160, configure the software product 152 and launch the software product 152, or a combination of software products 152, in a hosted computing environment (e.g., the service provider network 120) in a single interaction or order placed with the electronic marketplace 160.

Illustratively, the marketplace service 164 may generate one or more user interfaces, such as a customer user interface 145A, through which a customer, utilizing a customer computing device 140, or some other computing device, may browse the software products 152, submit queries for matching software products 152 and view information and details regarding specific software products 152. The marketplace service 164, or some other computing device, may facilitate the configuration and acquisition of the software product 152. In this regard, the marketplace service 164 or the billing service 166, may receive payment information from the customer computing device 140, as well as information specifying how a service provider network 120 should implement the software product 152.

The marketplace service 164 or the billing service 166 may also establish an account or update an account for a customer. The account information may include a variety of different information, such as one or more payment methods, billing preferences, address information, communication preferences, privacy preferences, and the like. Payment information might also be received from the customer that may not be used for charging the customer until the software product 152 is used in the service provider network 120 or, in some cases, on another computing device outside of the service provider network 120.

The billing service 166 is configured to provide functionality relating to billing customers for the use of the software products 152 based, at least in part, on billable units 172 defined by their associated software providers. As illustrated in FIG. 1, the billing service 166 includes a configuration component 122, a billing manager 124 that may include an authenticator 125, a usage-monitoring service 126 and a data store 127. While the configuration component 122, the billing manager 124, the usage-monitoring service 126 and the data store 127 are illustrated as being within the billing service 166, all or a portion of these components may be located in other locations. For example, the data store 127 may be located externally from the billing service 166. Similarly, the billing manager 124 may be part of the usage-monitoring service 126, the marketplace service 164, and the like. According to some configurations, the billing service 166 may be configured to charge a customer for use of computing resources provided by the service provider network 120 that are requested and used by the customer. For example, the billing service 166 and/or the service provider network 120 may cause a charge to be generated in response to a use of a computing resource provided by the service provider network 120 for use in executing a software product 152.

The configuration component 122 may be configured to set options relating to configuring billing options for one or more software products 152. For example, the configuration component 122 may be configured to determine what pricing models 168 to apply to customers as well as when the pricing model 168 is to be applied. As used herein, the term "pricing model" may refer to data that associates one or more fees to apply to an occurrence of a billable unit 172 during an execution of the software product 152.

According to some configurations, the software provider uses a software provider user interface 145B to set options that are associated with billing relating to one or more software products 152. For example, the software provider user interface 145B might be utilized to set options that define the billable units 172, the software product 152, the customers that are associated with the pricing model 168, a time at which the pricing model 168 is to be applied (e.g., during peak/non-peak times), and the like. Some or all of these options may be configured by default. For example, a default pricing model 168 may be associated with a software product 152 unless specifically overridden.

As discussed above, a software provider might define one or more billable units 172 that are used to charge for the use of a software product 152. Instead of being limited to a pricing model 168 that is time bound, the software provider may specify other criteria that are used to determine how to charge for the use of the software product 152. Generally, the software provider may define a billable unit 172 to charge for almost any type of interaction or operation associated with the use of the software product 152.

In some configurations, the billable units 172 are non-time bound pricing parameters such as a number of specified operations performed by the software product. For example, the operations might relate to a display of pages, printing of pages, frames rendered, and the like. In other examples, the billable units 172 might be associated with functionality of the software product accessed by a user. For instance, a billable unit 172 might be associated with a fee to charge for accessing the functionality to upload a document to a service and another fee to access the functionality to print one or more documents.

According to some examples, the software provider associates the defined billable units with one or more pricing models 168. As briefly discussed above, the pricing model 168 may specify the fee to be charged to one or more customers for use of the software product 152 that is based on the occurrences of the defined billable units 172. In some configurations, after the software provider determines the billable units 172 to charge for, the software provider configures the software product 152 to support billing for use of the software product 152 based at least in part on the occurrences of the billable units 172.

According to some examples, the software product 152 is configured to send billing data 128 to a billing service 166 that may be used to bill for use of the software product 152. For example, during execution of the software product 152 within the service provider network 120, the software product 152 may send messages that identify a number of occurrences of the billable units 172 to a billing manager 124. The messages may specify the number of occurrences of billable units 172 detected by the software product 152 within a specified time along with the price for each billable unit. The messages may also include data identifying the software product 152, the software provider, and the customer executing the software product. According to some configurations, a message may be sent to the billing service 166 for each billable unit 172 that is detected by the software product 152 as it is executing. In other examples, the messages may be sent at other times (e.g., periodically, at specified times, intervals, or in response to some other event).

The billing service 166 may be configured to verify data received in the message. For example, the billing manager 124 may utilize the authenticator 125 that may be configured to locate an account associated with the customer and verify the customer identified by the billing data 128 included in the message. As discussed briefly above, the software provider may not know PII of the customer. Instead, the software provider may use a unique identifier provided by the service provider network 120 that does not include PII to identify a customer. The authenticator 125 may be configured to determine that the customer identified by the software product 152 is a valid customer of the service provider network 120 and that the identified customer is authorized to execute the software product 152 (e.g., within the service provider network 120). After the authenticator 125 authenticates all or a portion of the billing data, the billing manager 124 may add billing data 128 to the data store 127, or some other data store, such that the customer executing the software product 152 may be charged for the use of the software product 152 in the manner specified by the provider of the software product 152. For example, the billing service 166 might use the billing data 128 create and provide an invoice 170 to the customer that includes charges for the occurrence of billable units 172.

In some configurations, the billing service 166 might aggregate the billable units 172 that occurred over a specified time to create the invoice 170 for the customer. For example, the billing service 166 may identify billable units 172 from the billing data 128 that are performed on behalf of a customer over a specified period of time (e.g., a day, a month or a year). As discussed above, the billing service 166 may cause an invoice to be generated for the customer that includes charges for the billable units 172 determined by the software product 152 as well as service provider network charges that are associated with the use of computing resources provided by the service provider network 120. For example, the billing service may charge for use of the computing resources used by the customer during the execution of the software product 152 in the service provider network.

In some examples, a software provider might set different prices for different customers. For example, some customers might be associated with one pricing model 168, whereas other customers are associated with a different pricing model 168. In some examples, a customer might enter a code (e.g., within a user interface) at some time during the execution of the software product (e.g., when the software product 152 begins executing) that may be used by the software product 152 to determine a charge for a billable unit. For instance, one code might indicate one charge per billable unit and another code might indicate a different charge for a billable unit. According to other configurations, a software provider might dynamically change the pricing of the software product 152. For example, pricing for a billable unit 172 might be lower during one time of the day and higher during another time. As another example, pricing for a billable unit 172 might be lower when computing resources of the service provider network 120 are readily available and higher when computing resources of the service provider network 120 are scarcer.

The pricing model 168 provided by the software provider might also be associated with more than one software product 152. For example, the software provider might charge for saving a document using one software product 152 and charge for printing the document using another software product 152. A pricing model 168 might also provide discounts for use of the software product. For example, the pricing model 168 might provide a discount for performance of a billable unit after a specified number of billable units have been performed, when the customer is determined to be using or has a subscription to another software product, and the like.

The billing manager 124 might also obtain and monitor other data that might be used to bill the customer for a use of the software product 152. For example, the billing service 166 might be configured to monitor the usage of a software product 152 using the usage-monitoring service 126. The usage information that might be monitored by the usage-monitoring service 126 may include information such as, but not limited to usage time of the software product 152, a type of virtual machine instance utilized to execute the software product 152, a number of virtual machine instances utilized by the software product 152, the amount and type of computing resources requested by the software product 152, and the like. According to some configurations, this usage information may be used by the billing service 166 to generate service provider network charges.

The billing service 166 may also be configured to process payments from customers and, in some examples, provide payment to the software providers of the software products 152. In some cases, the billing service 166 may generate an accounting record that may be used to generate an invoice 170 that is provided to the customer thereby charging the customer for use of the software product 152.

Figure 2:
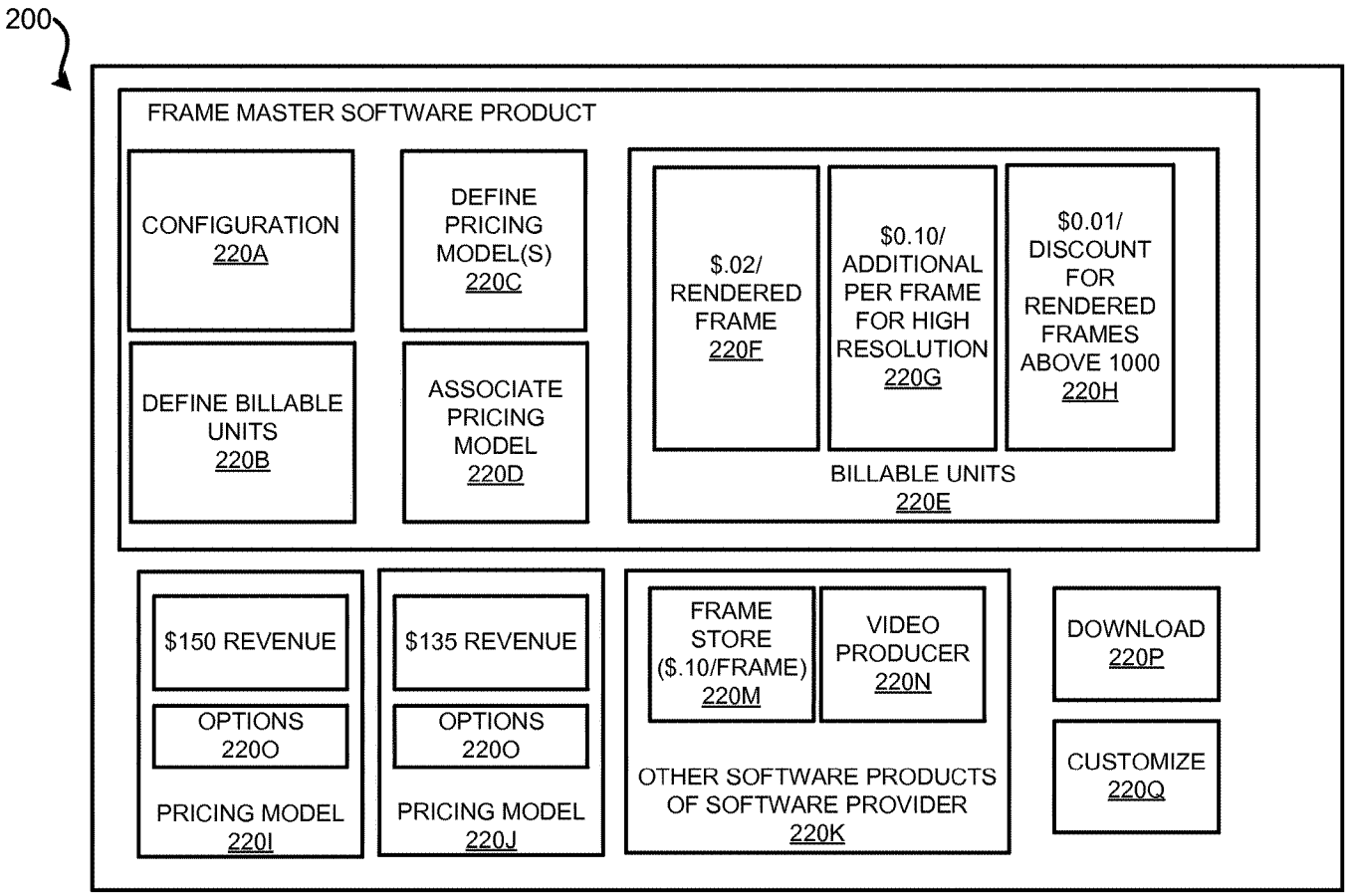
FIG. 2 is a screen diagram showing an illustrative graphical user interface that displays billing data and pricing models relating to one or more software products.
Figure 3:
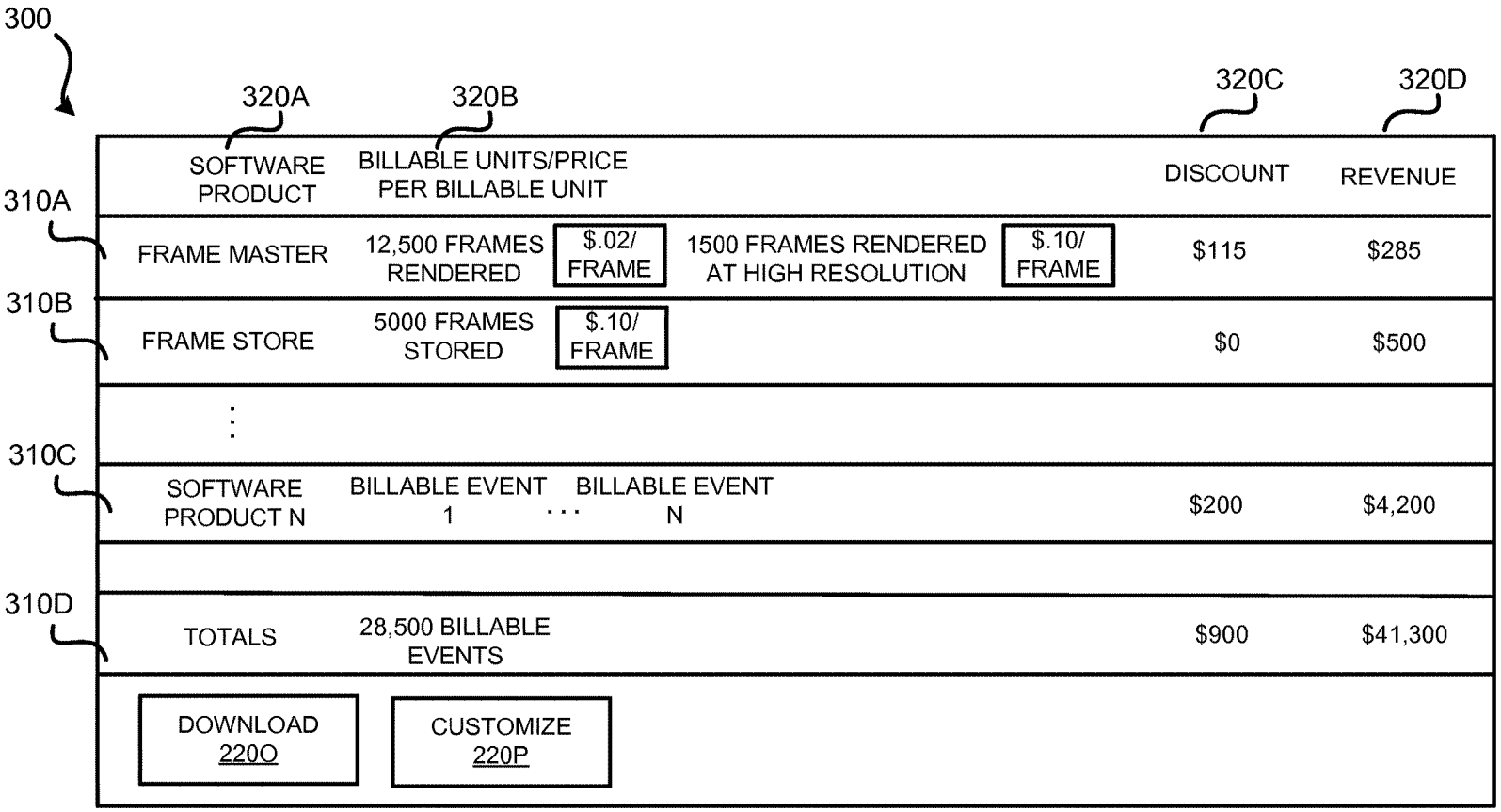
FIG. 3 is a screen diagram showing an illustrative graphical user interface that displays billing data relating to different software products that are associated with different pricing models.

The billing manager 124 included in the billing service 166 may be configured to provide billing data 128 to a software provider, such as a third party software provider using a software provider computing device 150. The billing manager 124 may be configured to provide billing data to a customer (e.g., provide an invoice 170). According to some configurations, the billing service 166 may be configured to provide billing data used in creating graphical user interfaces to display the billing data as illustrated in FIGS. 2 and 3. The billing manager 124 may also be configured to create reports that include all or a portion of the billing data. For example, the report may include a number of billable units for a period of time, a discount applied, revenue information, and the like.

According to some examples, the billing data that is provided is customizable. The billing data might also be provided using different mechanisms. For example, and without limitation, the billing data may be displayed in a GUI (e.g., within software provider user interface 145B), delivered in a document, transmitted via an email, and the like. In one example, billing data 128 is kept up to date in real or near real time. For example, when the billing data 128 is provided or a report is generated, the billing data 128 that is provided is the latest billing data 128 available. In some cases, historical billing data might also be provided. Additional details regarding providing billing data 128 are provided below.

Turning now to FIGS. 2-3, different examples of graphical user interfaces are illustrated that display information relating to the billing data 128 and billing for use of a software product 152 using billable units 172 defined at least in part by a software provider. The GUIs that are presented are for illustrative purposes only, and are not intended to be limiting.

FIG. 2 is a screen diagram showing an illustrative graphical user interface 200 that displays billing data 128 and pricing models 168 relating to one or more software products 152. As illustrated, the GUI 200 shows different information relating to billing for use of a software product 152 using billable units 172 defined by a software provider. In the current example, the GUI 200 shows information relating to the "frame master" software product 152. The frame master software product 152 might be configured to render frames (e.g., graphical frames) at different graphical resolutions. The GUI 200 might be generated by the marketplace service 164 or the billing service 166 shown in FIG. 1, and presented on a computing device, such as a software provider computing device 150 by an application. For example, the application might be a web browser application.

As discussed above, a software provider might specify one or more pricing models 168 that are used to determine the monetary charges for the use of the software product 152. In the current example, for the frame master software product 152, the GUI 200 shows a configuration UI element 220A, a define billable units UI element 220B, a define pricing model UI element 220C, an associate pricing model UI element 220D, a define billable units UI element 220E, a pricing model UI element 220I, a pricing model UI element 220J, an other software products of software provider UI element 220K, a download UI element 220P, and a customize option UI element 220Q. In some examples, all or a portion of the different UI elements might be selected to obtain additional information. For instance, a software provider, or some other authorized user, might select the configuration element 220A to configure options that are associated with the billing for the software product 152.

The define billable units UI element 220B is configured to allow the software provider to define or update information associated with the billable units 172 that are associated with a particular software product 152. As discussed above, the billable units 172 might relate to different criteria, such as processing operations performed by the software product 152, use of particular functionality provided by the software product 152, or the like. In the current example, the software provider has defined billable units 172 associated with rendering a frame and generating high-resolution frames.

The define pricing UI element 220C is configured to allow the software provider to define the pricing for each of the billable units 172. In the current example, the software provider has specified that two cents ($0.02) are to be charged for each rendered frame, an additional $0.10 is to be charged for each additional frame rendered using high-resolution, and to provide a one cent ($0.01) discount for frames rendered above one thousand total frames (not shown). As discussed above, the software provider is free to define the pricing model 168 in any manner that it determines.

The associate pricing model UI element 220D is configured to allow the software provider to specify the customers to which the pricing model 168 is to be applied. For example, one pricing model 168 might apply to one set of customers and another pricing model 168 might apply to other customers. In other examples, the pricing model 168 to be applied might be selected using different criteria (e.g., current demand for resources).

The billable units UI element 220E includes UI elements that are associated with different billable units 172 that may be used to determine a usage fee associated with the use of the software product 152. In the example illustrated in FIG. 2 for the frame master software product 152, the billable units UI element 220E includes a rendered frame UI element 220F that shows a charge of $0.02 for each rendered frame, a high resolution UI element 220G that shows an additional charge of $0.10 for each frame rendered at a high resolution, and a discount UI element 220H that shows a discount of $0.01 for each frame rendered above 1000.

The pricing model UI element 220I and 220J illustrate billing data 128 that is associated with different pricing models 168. In the current example, the pricing model 2201 shows that $150 of revenue is associated with a first pricing model 168. The pricing model 220J shows that $135 of revenue is associated with a second pricing model. According to some configurations, the options UI elements 2200 may be selected to configure the data that is displayed in the pricing model UI elements 2201 and 220J. For example, the UI elements might show billable units 172 or revenue information within some specified period.

The software provider might also filter the group of customers based on various parameters that are associated with the software product 152 such as, but not limited to, the version of the software product 152, a geographic region associated with the customers, an instance type used to execute the software product 152 in the service provider network 120, a longevity of the customer (e.g., a new customer or a customer that has been a customer for some specified period of time), and the like. In still other examples, the software provider might elect to display information that is based on a particular type of customer support, such as phone support, email support, or some other type of support.

Information relating to the other software products 152 that the software provider has provided to the electronic marketplace 160 might also be displayed within the GUI 200. As illustrated, the other software products UI element 220K shows that the software purchase also has a frame store software product 152 in UI element 220M and a video producer software product 152 in UI element 220N.

In some configurations, a software provider might select one of the UI elements shown in the other software products of customer UI element 220K to obtain more detailed information about the selected software product 152. For example, selecting either the frame store UI element 220M or the video producer UI element 220N might display billing data that is the same or similar to the billing data 128 that is displayed in the billable units UI element 220E.

A software provider might also be able to customize the GUI 200 by selecting the customize UI element 220Q. In response to selecting the customize UI element 220Q, a software provider may then be prompted to select the different information that they would like to include in the display of the GUI 200. For example, a software provider may select from a list (or some other UI element or input method) the billing data 128 that it would like displayed. In another example, the user may select how the billing data 128 is to be displayed. For example, the user may request to have the billing data 128 displayed as raw data, as a graphical representation (e.g., tables, charts, graphs), or in some other format. A user may also request to have historical information displayed in the GUI 200 (not shown). For example, a user may request to see a time series display of the billing units 172 of the software product 152, or some other data.

The information presented in the GUI 200 might also be downloaded for later use. As illustrated, a user may select the download UI element 220P to download the information to a local data store, a network data store, or to another location. The billing data 128 may be downloaded in one or more formats. For example, a user may download all or a portion of the billing data as a text file, a spreadsheet file, a word-processing file, or some other file.

FIG. 3 is a screen diagram showing an illustrative GUI 300 that displays billing data 128 relating to different software products 152 that may be associated with different pricing models 168. In the current example, the GUI 300 includes rows 310A-310C corresponding to different software products 152, and columns 320A-320D for providing billing data 128 associated with the different software products 152 of a software provider.

As illustrated, the GUI 300 shows billing data 128 relating to the different software products 152 available for purchase from the electronic marketplace 160 and configured to execute in the service provider network 120. In other examples, all or a portion of the software products 152 might be configured to execute outside of the service provider network 120 (e.g., on a customer computing device 140).

In the current example, each software product 152 displayed in the GUI 300 includes a display of billing data 128 relating to the respective software product 152. As illustrated, each row 310A-310C that is associated with a software product 152 displays billable units 320B, a discount 320C, and the revenue 320F. In other examples, additional billing data 128 or more detailed information might be provided in the GUI 300. For example, the revenue information 320D might include cost information relating to software usage fees, service provider network fees, or other costs that might be associated with executing the software product 152 in a service provider network 120.

The billable units element 320B shows the billable units 172 that are associated with the software product 152 and a price per billable unit. For example, the GUI 300 shows for the frame master software product shown in row 310A that 12,500 frames have been rendered at two cents per frame and 1500 frames have been rendered at high resolution at a cost of ten cents per frame. For the frame store software product 152, the billable unit relates to a number of frames stored and a price per frame stored (e.g., 5000 frames stored at a cost of ten cents per frame). As discussed above, a software product 152 may be associated with any number of billable units that may be specified and/or defined by the software provider.

The discount UI element 320C shows a discount applied to the software product 152. In the current example for the frame master software product, the discount is $115. The revenue UI element 320F shows revenue generated for the software product 152. A totals row 310D may also be displayed that shows the aggregated totals for each of the software products 152.

In some configurations, a software provider may customize the GUI 300 by selecting the customize UI element220P. The information presented in the GUI 300 might also be downloaded for later use. As illustrated, a software provider may select the download UI element 220O to download the information to a local data store, a network data store, or to another location. The billing data 128 might be downloaded in one or more formats. For example, a user may download all or a portion of the billing data 128 as a text file, a spreadsheet file, a word-processing file, or some other file.

According to some configurations, a software provider may also be permitted to drill down into details of a particular software product 152. For example, a software provider may select a user interface element (not shown) to drill down to show additional details associated with the billing data 128. As can be seen, the GUI 300 allows an authorized user, such as a third party software provider that submitted the software product 152 to the electronic marketplace 160, to view the billing data 128 for a software product 152.

Figure 4:
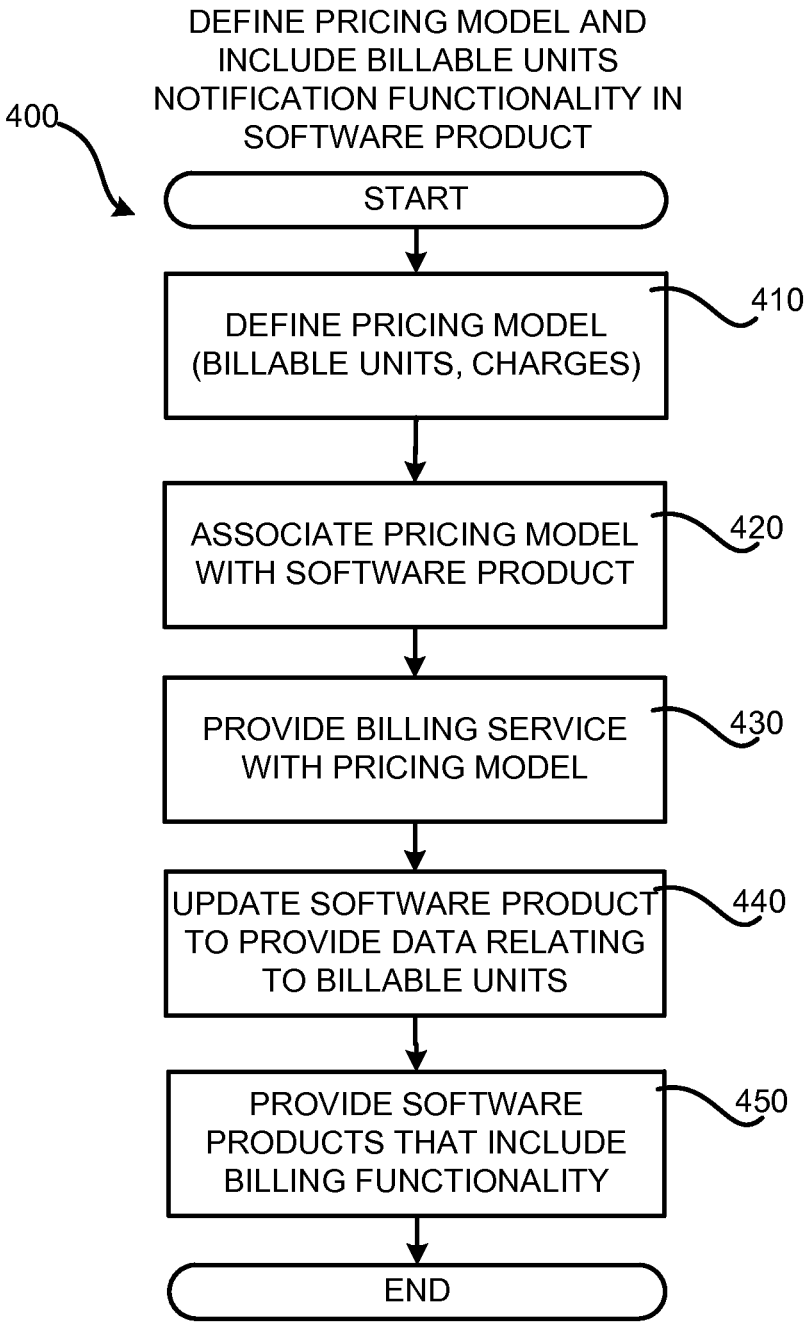
FIG. 4 is a flow diagram showing a routine illustrating aspects of a mechanism disclosed herein for defining a pricing model and updating a software product to include billing functionality.
Figure 5:
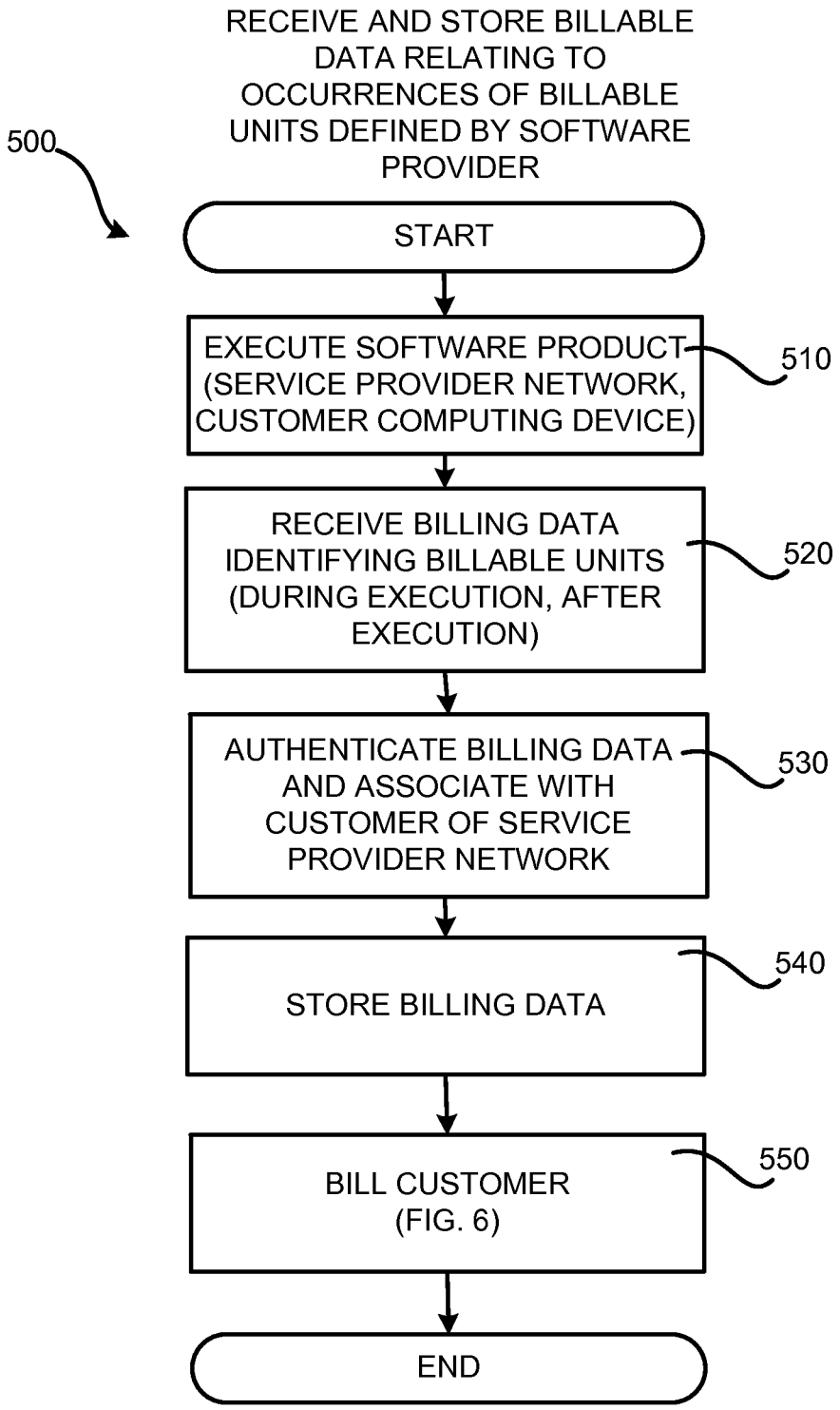
FIG. 5 is a flow diagram showing a routine illustrating aspects of a mechanism disclosed herein for receiving billing data identifying occurrences of billable units during execution of a software product and for billing a customer based at least in part on the billable units.
Figure 6:
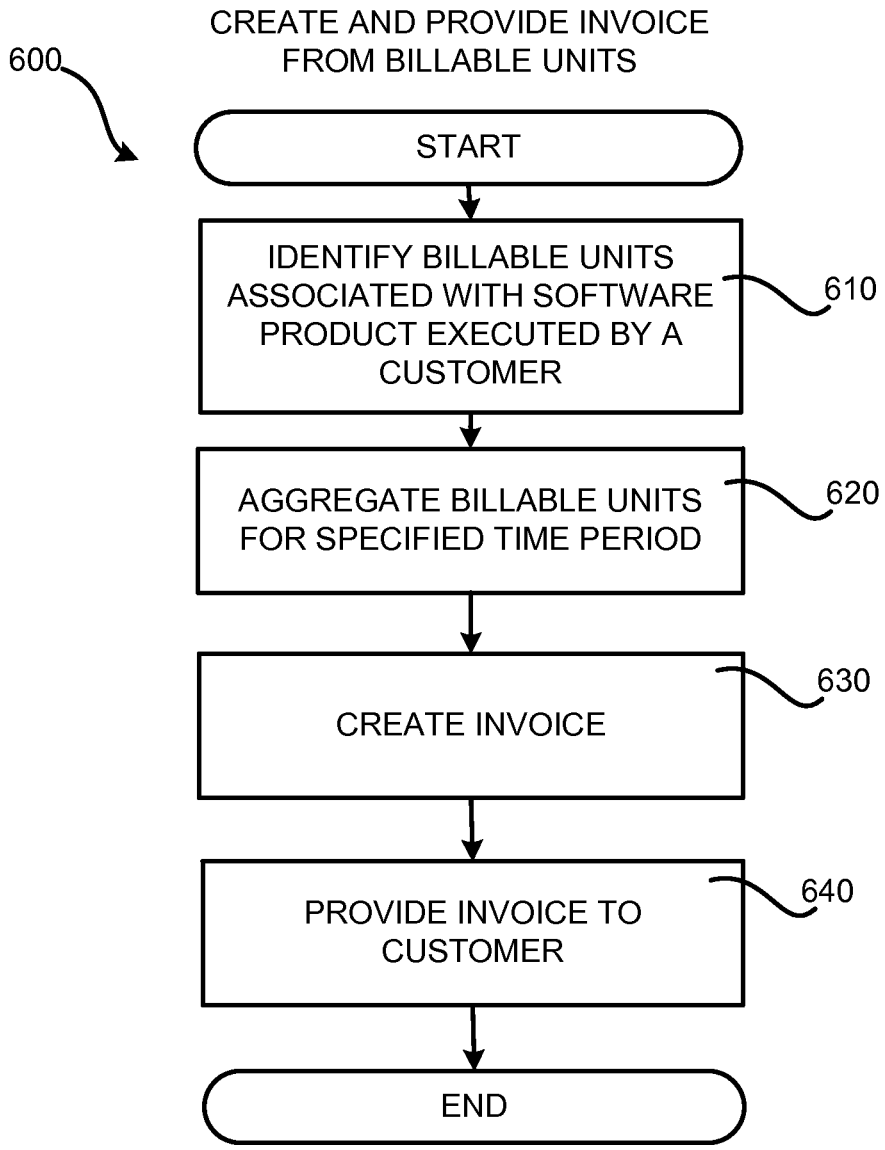
FIG. 6 is a flow diagram showing a routine illustrating aspects of a mechanism disclosed herein for creating and providing an invoice to a customer that uses a software product based upon the occurrence of billable units defined by the provider of the software product.

FIGS. 4-6 are flow diagrams showing routines that illustrate aspects of billing for use of a software product 152 according to billable units specified by the provider of the software product 152, according to examples disclosed herein. It should be appreciated that the logical operations described herein with respect to FIGS. 4-6, and the other FIGS., may be implemented (1) as a sequence of computer implemented acts or program modules running on a computing system and/or (2) as interconnected machine logic circuits or circuit modules within the computing system.

The implementation of the various components described herein is a matter of choice dependent on the performance and other requirements of the computing system. Accordingly, the logical operations described herein are referred to variously as operations, structural devices, acts, or modules. These operations, structural devices, acts, and modules may be implemented in software, in firmware, in special purpose digital logic and any combination thereof. It should also be appreciated that more or fewer operations may be performed than shown in the FIGS. and described herein. These operations may also be performed in parallel, or in a different order than those described herein.

FIG. 4 is a flow diagram showing a routine 400 illustrating aspects of a mechanism disclosed herein for defining a pricing model 168 and updating a software product 152 to include billing functionality. The routine 400 may begin at operation 410, where a pricing model 168 may be defined. As discussed above, the pricing model 168 may define what usage fees to charge based upon the occurrences of one or more billable units 172 specified by the software provider. For example, a pricing model 168 may be defined to charge a specified usage fee for each occurrence of a billable unit 172. According to some configurations, the software provider may associate a discount that may be applied based on the use of the software product 152 and/or other criteria defined by the software provider.

From operation 410, the routine 400 may move to operation 420 where the pricing model 168 may be associated with a software product 152. As described above, the software provider may create different pricing models 168 for a software product 152. For example, one pricing model 168 might be associated with one group of customers whereas another pricing model 168 is associated with a second group of customers. In other examples, the pricing model 168 might be associated with the software product 152 based on an availability of computing resource in the service provider network 120.

From operation 420, the routine 400 may move to operation 430 where the billing service 166 may be provided with the pricing model 168. In some examples, the pricing models 168 are stored in a data store 127 that is associated with the billing service 166. As discussed above, the pricing model 168 may include the billable units 172 that may be received during operation of a software product 152 as well as how to charge for those billable units 172. In some examples, each billable unit 172 may be associated with a particular fee per occurrence.

From operation 430, the routine 400 may move to operation 440 where the software product 152 is updated to include billing functionality. As discussed above, the billing functionality may be configured to provide the billing service 166 billing data 128 that identifies the occurrence of billable units 172 during operation of the software product 152.

From operation 440, the routine 400 may move to operation 450 where the software product 152 updated with the billing functionality is provided to the electronic marketplace 160 and made available to customers. The routine 400 may then proceed to an end operation. Alternately, the routine 400 might proceed back to repeat some or all of the processing operations described above. For example, from operation 450, the routine 400 may proceed back to operation 410.

FIG. 5 is a flow diagram showing a routine 500 illustrating aspects of a mechanism disclosed herein for receiving billing data 128 identifying occurrences of billable units 172 during execution of a software product 152 and creating an invoice 170 used to charge the customer based at least in part on the occurrences of the billable units 172. The routine 500 may begin at operation 510, where the software product 152 is executed. As discussed above, the software product 152 may be executed in the service provider network 120 and/or on a customer computing device 140.

From operation 510, the routine 500 may move to operation 520 where billable units 172 may be received during execution of the software product 152, or at some other time. As discussed above, the software product 152 may be configured to generate and send billing data 128 to a billing service 166 when a billable unit 172 occurs during execution of the software product 152. In other cases, billing data 128 identifying billable units 172 may be provided to the billing service 166 at other times. For example, the billable units 172 might be provided to the billing service 166 at specified times.

From operation 520, the routine 500 may move to operation 530 where the billing data 128 may be authenticated. The billing data 128 may be authenticated by the authenticator 125 that is part of the billing manager 125. As discussed above, the authenticator 125 may be configured to verify that the customer identified to be charged is a valid customer of the service provider network 120 and that the customer requested execution of the software product 152.

From operation 530, the routine 500 may move to operation 540 where the billing data 128 may be stored. As discussed above, the billing data 128 may be stored in a data store 127, or at some other location. The stored billing data 128 may be used by the billing service 166 to generate an invoice 170 for the customer.

From operation 540, the routine 500 may move to operation 550 where the customer may be billed. As discussed in more detail below with regard to FIG. 6, the stored billing data 128 may be accessed to identify the occurrence of billable units 172 that are chargeable to the customer. The routine 500 may then proceed to an end operation. Alternately, the routine 500 might proceed back to repeat some or all of the processing operations described above. For example, from operation 550, the routine 500 may proceed back to operation 510.

FIG. 6 is a flow diagram showing a routine 600 illustrating aspects of a mechanism disclosed herein for creating and providing an invoice 170 to a customer of a software product 152 based upon the occurrence of billable units 172 defined by the software provider. The routine 600 may begin at operation 610, where billable units 172 associated with the software product 152 executed by a customer are identified. As discussed above, the software provider may determine how much to charge the customer for each occurrence of the billable units 172.

From operation 610, the routine 600 may move to operation 620 where billable units 172 for a specified time may be aggregated for a customer. As discussed above, the billable units 172 might be aggregated for a day, a week, a month, or some other time. In some examples, the billable units 172 might be associated with charges for more than one software product 152.

From operation 620, the routine 600 may move to operation 630 where an invoice 170 is created. As discussed above, the invoice 170 may be created using one or more pricing models 168 specified by the software provider. As also discussed above, the billing service 166 may cause the invoice 170 to be generated for the customer that includes charges for the billable units as well as service provider network charges.

From operation 630, the routine 600 may move to operation 640 where the invoice 170 may be provided to the customer. The invoice 170 may be provided by the service provider network 120 to a customer at predefined times. As discussed above, the invoice 170 may be provided to the customer on behalf of the software provider by the billing service 166 that may be associated with the service provider network 120. The routine 600 then proceeds to an end operation. Alternately, some or all of the processing operations described above may be repeated. For example, from operation640, the routine 600 may proceed back to operation 610.

Figure 7:
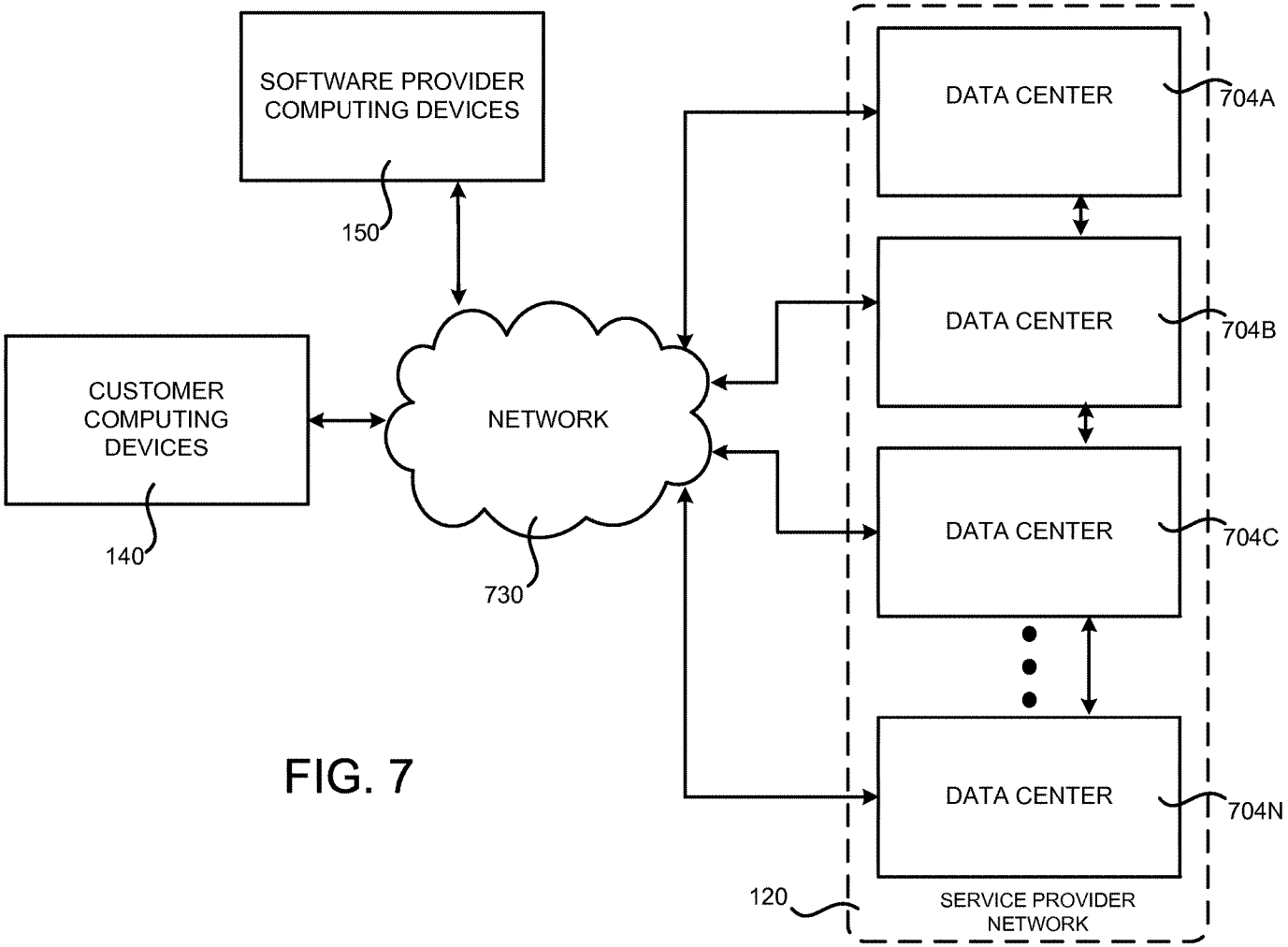
FIG. 7 is a system and network diagram that shows one illustrative operating environment for the technologies disclosed herein that includes a service provider network.

FIG. 7 and the following description are intended to provide a brief, general description of a suitable computing environment in which the technologies described herein may be implemented. In particular, FIG. 7 is a system and network diagram that shows an illustrative operating environment that includes a service provider network 120. As discussed above, the service provider network 120 can provide virtual machine instances and computing resources on a permanent or an as-needed basis.

The computing resources provided by the service provider network 120 may include various types of resources, such as data processing resources, data storage resources, networking resources, data communication resources and the like. Each type of computing resource may be general-purpose or may be available in a number of specific configurations. For example, and as will be described in greater detail below, data processing resources may be available as virtual machine instances in a number of different configurations. The virtual machine instances may be configured to execute applications, including Web servers, application servers, media servers, database servers and other types of applications. Data storage resources may include file storage devices, block storage devices and the like. Each type or configuration of a virtual machine instance of a computing resource may be available in different sizes, such as large resources, consisting of many processors, large amounts of memory, and/or large storage capacity, and small resources consisting of fewer processors, smaller amounts of memory and/or smaller storage capacity.

The computing resources provided by the service provider network 120 are enabled in one implementation by one or more data centers 704A-704N (which may be referred to herein singularly as "a data center 704" or collectively as "the data centers 704"). The data centers 704 are facilities utilized to house and operate computer systems and associated components. The data centers 704 typically include redundant and backup power, communications, cooling and security systems. The data centers 704 might also be located in geographically disparate locations. One illustrative configuration for a data center 704 that implements some or all of the concepts and technologies disclosed herein for value based pricing in the service provider network 120 will be described below with regard to FIG. 8.

The users and customers of the service provider network 120 may access the computing resources provided by the data centers 704 over a suitable data communications network, such as a Wide Area Network ("WAN"), as illustrated by network 730. Although a WAN might be used, it should be appreciated that a local-area network ("LAN"), the Internet, or any other networking topology known in the art that connects the data centers 704 to the customer computing devices 140, the software provider computing devices 150 may be utilized. It should also be appreciated that combinations of such networks might also be utilized.

Figure 8:
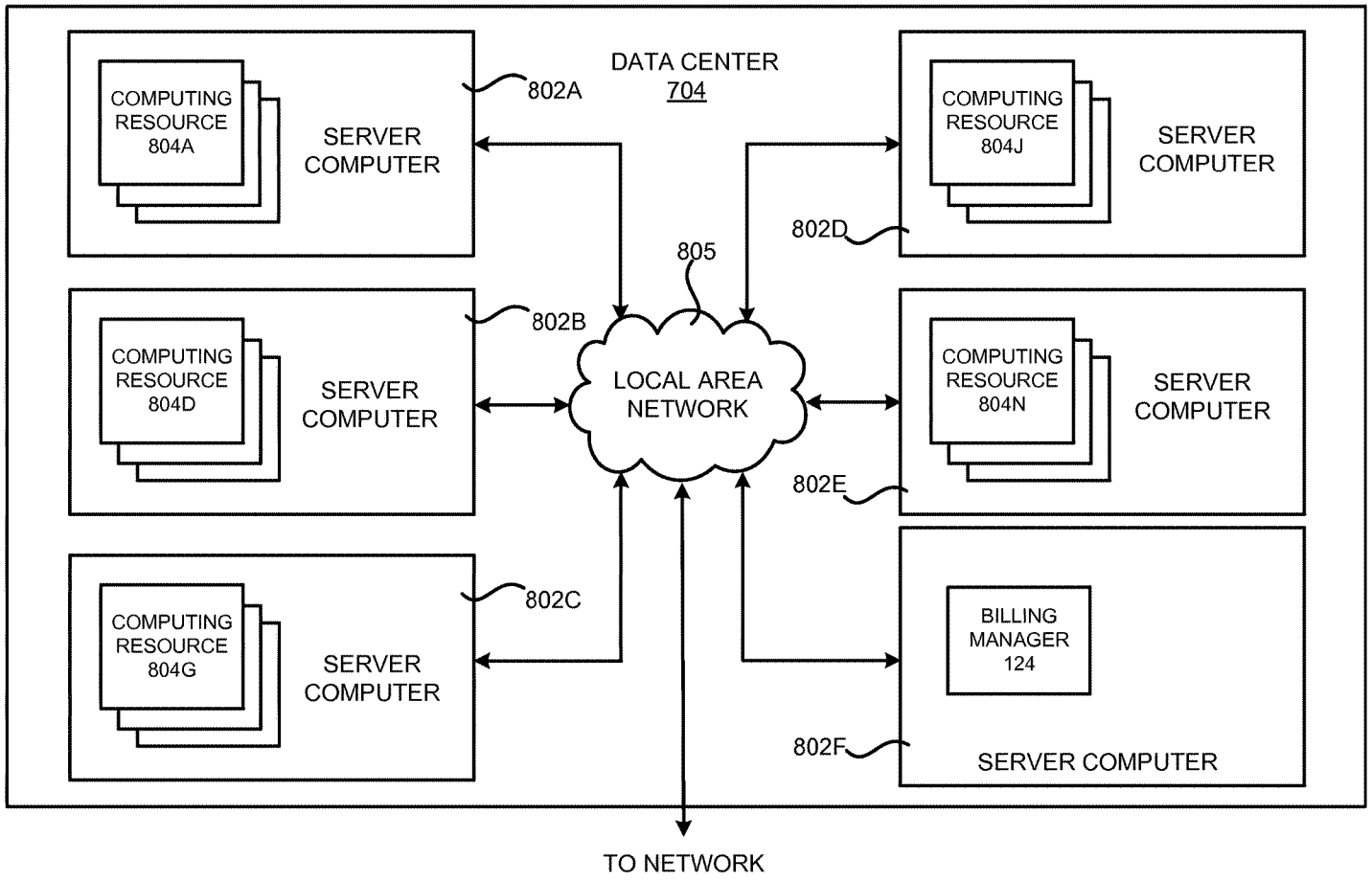
FIG. 8 is a computing system diagram that illustrates one configuration for a data center that implements aspects of a service provider network, including some or all of the concepts and technologies disclosed herein for using billable units defined by a software provider to charge for use of a software product.

FIG. 8 is a computing system diagram that illustrates one configuration for a data center 704 that implements aspects of a service provider network 120, including some or all of the concepts and technologies disclosed herein for using billable units 172 defined by a software provider to charge for use of a software product 152. The example data center 704 shown in FIG. 8 includes several server computers 802A-802E (which may be referred to herein singularly as "a server computer 802" or in the plural as "the server computers 802") for providing computing resources. The server computers 802 may be standard tower or rack-mount server computers configured appropriately for providing the computing resources described herein. According to some examples, the server computers 802 are configured to execute the software products 152 as described above.

In some examples, some of the computing resources 804 are virtual machine instances. As known in the art, a virtual machine instance is an instance of a software implementation of a machine (i.e. a computer) that executes programs like a physical machine. Each of the server computers 802 may be configured to execute an instance manager (not shown) capable of instantiating and managing computing resources and instances of computing resources. In the case of virtual machine instances, for example, the instance manager might be a hypervisor or another type of program configured to enable the execution of multiple virtual machine instances on a single server computer 802, for example.

It should be appreciated that although the technologies disclosed herein are described primarily in the context of virtual machine instances, other types of computing resources can be utilized with the concepts and technologies disclosed herein. For instance, the technologies disclosed herein might be utilized with hardware resources, data storage resources, data communications resources, networking resources, database resources and with other types of computing resources.

The data center 704 shown in FIG. 8 also includes a server computer 802F reserved for executing software components for managing the operation of the data center 704, the server computers 802, virtual machine instances, and other resources within the service provider network 120. The server computer 802F might also execute the billing manager 124 and store the pricing models 168. Details regarding the operation of each of these components have been provided above. In this regard, it should be appreciated that while these components are illustrated as executing within the service provider network 120, computing systems that are external to the service provider network 120 might also be utilized to execute some or all of these components. Other configurations might also be utilized.

In the example data center 704 shown in FIG. 8, an appropriate local area network ("LAN") 805 is utilized to interconnect the server computers 802A-802E and the server computer 802F. The LAN 805 is also connected to the network 730 illustrated in FIG. 7. It should be appreciated that the configuration and network topology illustrated in FIGS. 7 and 8 has been greatly simplified and that many more computing systems, networks and networking devices may be utilized to interconnect the various computing systems disclosed herein. Appropriate load balancing devices or software modules might also be utilized for balancing a load between each of the data centers 704A-704N, between each of the server computers 802A-802E in each data center 704 and between virtual machine instances and other types of computing resources provided by the service provider network 120.

It should be appreciated that the data center 704 described in FIG. 8 is merely illustrative and that other implementations might also be utilized. Additionally, it should be appreciated that the functionality provided by these components might be implemented in software, hardware, or a combination of software and hardware. Other implementations should be apparent to those skilled in the art.

Figure 9:
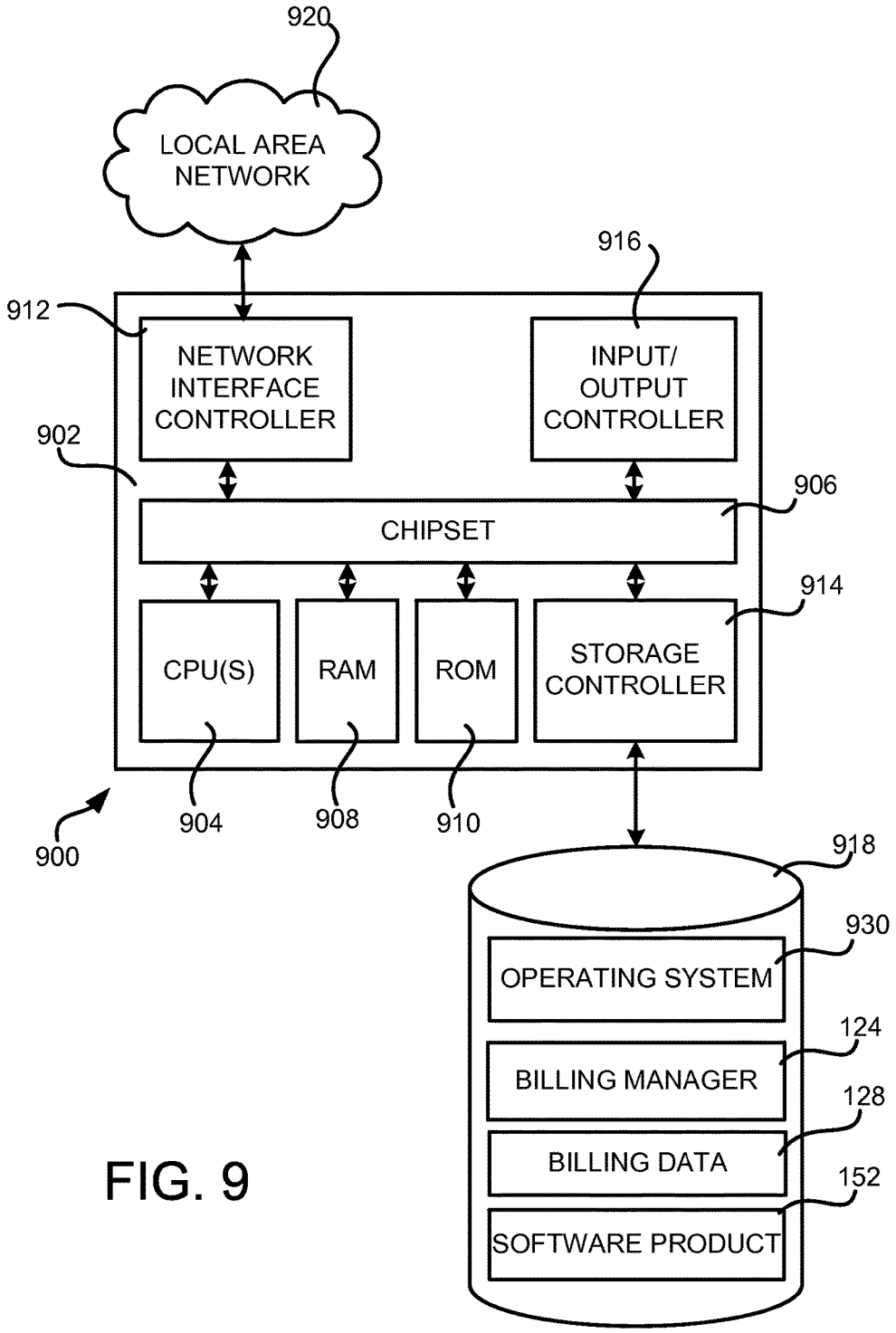
FIG. 9 is a computer architecture diagram showing one illustrative computer hardware architecture for implementing a computing device that might be utilized to implement aspects of the various technologies presented herein.

FIG. 9 shows an example computer architecture for a computer 900 capable of executing program components for pricing the use of software products in the manner described above. The computer architecture shown in FIG. 9 illustrates a conventional server computer, workstation, desktop computer, laptop, tablet, network appliance, personal digital assistant ("PDA"), e-reader, digital cellular phone, or other computing device, and may be utilized to execute any of the software components presented herein. For example, the computer architecture shown in FIG. 9 may be utilized to execute software components for performing operations as described above. The computer architecture shown in FIG. 9 might also be utilized to implement a customer computing device 140, a software provider computing device 150 or any other of the computing systems described herein.

The computer 900 includes a baseboard 902, or "motherboard," which is a printed circuit board to which a multitude of components or devices may be connected by way of a system bus or other electrical communication paths. In some examples, one or more central processing units ("CPUs") 904 operate in conjunction with a chipset 906. The CPUs 904 may be standard programmable processors that perform arithmetic and logical operations necessary for the operation of the computer 900.

The CPUs 904 perform operations by transitioning from one discrete, physical state to the next through the manipulation of switching elements that differentiate between and change these states. Switching elements may generally include electronic circuits that maintain one of two binary states, such as flip-flops and electronic circuits that provide an output state based on the logical combination of the states of one or more other switching elements, such as logic gates. These basic switching elements may be combined to create more complex logic circuits, including registers, adders-subtractors, arithmetic logic units, floating-point units and the like.

The chipset 906 provides an interface between the CPUs 904 and the remainder of the components and devices on the baseboard 902. The chipset 906 may provide an interface to a RAM 908, used as the main memory in the computer 900. The chipset 906 may further provide an interface to a computer-readable storage medium such as a read-only memory ("ROM") 910 or non-volatile RAM ("NVRAM") for storing basic routines that help to startup the computer 900 and to transfer information between the various components and devices. The ROM 910 or NVRAM may also store other software components necessary for the operation of the computer 900 in accordance with the technologies described herein.

The computer 900 may operate in a networked environment using logical connections to remote computing devices and computer systems through a network, such as the local area network 920. The chipset 906 may include functionality for providing network connectivity through a network interface controller ("NIC") 912, such as a gigabit Ethernet adapter. The NIC 912 is capable of connecting the computer 900 to other computing devices over the local area network 920. It should be appreciated that multiple NICs 912 may be present in the computer 900, connecting the computer to other types of networks and remote computer systems.

The computer 900 may be connected to a mass storage device 918 that provides non-volatile storage for the computer. The mass storage device 918 may store system programs, application programs, other program modules and data, which have been described in greater detail herein. The mass storage device 918 may be connected to the computer 900 through a storage controller 914 connected to the chipset 906. The mass storage device 918 may consist of one or more physical storage units. The storage controller 914 may interface with the physical storage units through a serial attached SCSI ("SAS") interface, a serial advanced technology attachment ("SATA") interface, a fiber channel ("FC") interface, or other type of interface for physically connecting and transferring data between computers and physical storage units.

The computer 900 may store data on the mass storage device 918 by transforming the physical state of the physical storage units to reflect the information being stored. The specific transformation of physical state may depend on various factors, in different implementations of this description. Examples of such factors may include, but are not limited to, the technology used to implement the physical storage units, whether the mass storage device 918 is characterized as primary or secondary storage and the like.

For example, the computer 900 may store information to the mass storage device 918 by issuing instructions through the storage controller 914 to alter the magnetic characteristics of a particular location within a magnetic disk drive unit, the reflective or refractive characteristics of a particular location in an optical storage unit, or the electrical characteristics of a particular capacitor, transistor, or other discrete component in a solid-state storage unit. Other transformations of physical media are possible without departing from the scope and spirit of the present description, with the foregoing examples provided only to facilitate this description. The computer 900 may further read information from the mass storage device 918 by detecting the physical states or characteristics of one or more particular locations within the physical storage units.

In addition to the mass storage device 918 described above, the computer 900 may have access to other computer-readable storage media to store and retrieve information, such as program modules, data structures, or other data. It should be appreciated by those skilled in the art that computer-readable storage media is any available media that provides for the non-transitory storage of data and that may be accessed by the computer 900.

By way of example, and not limitation, computer-readable storage media may include volatile and non-volatile, removable and non-removable media implemented in any method or technology. Computer-readable storage media includes, but is not limited to, RAM, ROM, erasable programmable ROM ("EPROM"), electrically-erasable programmable ROM ("EEPROM"), flash memory or other solid-state memory technology, compact disc ROM ("CD-ROM"), digital versatile disk ("DVD"), high definition DVD ("HD-DVD"), BLU-RAY, or other optical storage, magnetic cassettes, magnetic tape, magnetic disk storage or other magnetic storage devices, or any other medium that can be used to store the desired information in a non-transitory fashion.

The mass storage device 918 may store an operating system 930 utilized to control the operation of the computer 900. According to some configurations, the operating system comprises the LINUX operating system. According to another configurations, the operating system comprises the WINDOWS® SERVER operating system from MICROSOFT Corporation. According to further configurations, the operating system may comprise the UNIX operating system. It should be appreciated that other operating systems may also be utilized. The mass storage device 918 may store other system or application programs and data utilized by the computer 900, such as components that include the billing manager 124, the billing data 128, the software product 152 and/or any of the other software components and data described above. The mass storage device 918 might also store other programs and data not specifically identified herein.

In some configurations, the mass storage device 918 or other computer-readable storage media is encoded with computer-executable instructions that, when loaded into the computer 900, transform the computer from a general-purpose computing system into a special-purpose computer capable of implementing the technologies described herein. These computer-executable instructions transform the computer 900 by specifying how the CPUs 904 transition between states, as described above. According to some examples, the computer 900 has access to computer-readable storage media storing computer-executable instructions which, when executed by the computer 900, perform the various routines described above with regard to FIGS. 4-6. The computer 900 might also include computer-readable storage media for performing any of the other computer-implemented operations described herein.

The computer 900 may also include one or more input/output controllers 916 for receiving and processing input from a number of input devices, such as a keyboard, a mouse, a touchpad, a touch screen, an electronic stylus, or other type of input device. Similarly, the input/output controller 916 may provide output to a display, such as a computer monitor, a flat-panel display, a digital projector, a printer, a plotter, or other type of output device. It will be appreciated that the computer 900 may not include all of the components shown in FIG. 9, may include other components that are not explicitly shown in FIG. 9, or may utilize an architecture completely different than that shown in FIG. 9.

Based on the foregoing, it should be appreciated that technologies for providing value-based pricing for software products that is specified at least in part by a software provider have been presented herein. Moreover, although the subject matter presented herein has been described in language specific to computer structural features, methodological acts and computer readable media, it is to be understood that the invention defined in the appended claims is not necessarily limited to the specific features, acts, or media described herein. Rather, the specific features, acts and media are disclosed as example forms of implementing the claims.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the example technologies and applications illustrated and described, and without departing from the true spirit and scope of the present invention, which is set forth in the following claims.

What is claimed is:

1. A non-transitory computer-readable storage medium having computer-executable instructions stored thereupon which, when executed by one or more computers, cause the one or more computers to:

receive a software product;

execute the software product on a virtual machine instance provided by a service provider network in response to a request from a customer of the service provider network;

receive billing data generated by an instance of the software product executing on the virtual machine instance, a software product identifier that identifies the software product, a customer identifier that identifies the customer, and an amount to be charged per occurrence of the at least one billable unit, wherein the customer identifier does not include personally identifiable information, the billing data indicating an occurrence of at least one billable unit identified by the software product during the execution of the software product on the virtual machine instance in the service provider network, and wherein the at least one billable unit is associated with one or more of an operation performed by the software product, a functionality provided by the software product, or an amount of data processed by the software product;

associate the billing data with the customer of the service provider network;

store the billing data generated by the instance of the software product in a data store associated with the service provider network;

identify service provider network charges generated by the service provider network, the service provider network charges associated with a use of computing resources provided by the service provider network and used by the customer during the execution of the software product in the service provider network, wherein the computing resources include computing devices for providing the virtual machine instance, and wherein the computing resources are different from the at least one billable unit; and cause to generate, at the service provider network, an invoice, the invoice consolidating billing data charges associated with at least a portion of the billing data generated by the instance of the software product and at least a portion of the service provider network charges generated by the service provider network.

2. The non-transitory computer-readable storage medium of claim 1, wherein associate the billing data with the customer comprises authenticating the customer of the service provider network.

3. The non-transitory computer-readable storage medium of claim 1, wherein receive the billing data comprises receiving the billing data at a billing service of the service provider network, the billing data identifying an amount to be charged.

4. The non-transitory computer-readable storage medium of claim 1, wherein a third party defines an amount to be charged for an occurrence of the billable unit.

5. A system, comprising:

one or more computing devices associated with a service provider network, the one or more computing devices configured to receive a software product;

execute the software product on a virtual machine instance in response to a request from a customer of the service provider network;

receive billing data generated by the software product, a software product identifier that identifies the software product, a customer identifier that identifies the customer, and an amount to be charged per occurrence of the at least one billable unit, wherein the customer identifier does not include personally identifiable information, the billing data indicating an occurrence of a billable unit that occurred during an execution of the software product on the virtual machine instance;

associate the billing data with the customer of the service provider network; identify service provider network charges generated by the service provider network and associated with the customer, the service provider network charges associated with a use of computing resources provided by the service provider network in response to the request of the customer, wherein the computing resources include the one or more computing devices and, wherein the service provider network charges are different from the billable unit; and cause an invoice to be created for the customer, the invoice created based, at least in part, on at least a portion of the billing data generated by the software product and at least a portion of the service provider network charges generated by the service provider network.

6. The system of claim 5, further comprising one or more additional computing devices operative to execute the software product in the service provider network.

7. The system of claim 5, wherein the one or more computers are further configured to store the billing data in a data store associated with the service provider network.

8. The system of claim 5, wherein the billable unit is associated with a specified operation performed by the software product.

9. The system of claim 5, wherein the billing data comprises a software product identifier that identifies the software product, a customer identifier that identifies the customer executing the software product, and a billable unit identifier that identifies the billing unit.

10. The system of claim 5, wherein the one or more computing devices are configured to authenticate that the billing data is associated with the customer.

11. The system of claim 5, wherein the one or more computing devices are further configured to provide a graphical user interface to display data associated with the billable unit.

12. The system of claim 5, wherein the one or more computing devices are further configured to select a pricing model based, at least in part, on an availability of the computing resources provided by the service provider network at a time of the execution of the software product.

13. A computer-implemented method, comprising: receiving a software product;

executing the software product on a virtual machine instance in response to a request from a customer of a service provider network;

receiving billing data generated by the software product executing on the virtual machine instance, a software product identifier that identifies the software product, a customer identifier that identifies the customer, and an amount to be charged per occurrence of the at least one billable unit, wherein the customer identifier does not include personally identifiable information, the billing data identifying an occurrence of a billable unit;

associating the billing data with a customer of the service provider network;

identifying service provider network charges generated by the service provider network and associated with the customer, the service provider network charges associated with a use of computing resources provided by the service provider network in response to a request of the customer, wherein the computing resources include computing devices associated with the virtual machine instance and the service provider network and wherein the computing resources are different from the billable unit; and causing an invoice to be created for a customer based, at least in part, on at least a portion of the billing data generated by the software product and at least a portion of the service provider network charges generated by the service provider network.

14. The computer-implemented method of claim 13, wherein receiving the billing data generated by the software product comprises receiving the billing data at a billing service within the service provider network during a time the software product is executing within the service provider network.

15. The computer-implemented method of claim 13, wherein associating the billing data with the customer of the service provider network comprises authenticating a validity of the billing data.

16. The computer-implemented method of claim 13, further comprising storing at least a portion of the billing data in a data store associated with the service provider network.

17. The computer-implemented method of claim 13, wherein causing the invoice to be created comprises utilizing a pricing model associated with the customer to determine a charge for the billable unit.

18. The non-transitory computer-readable storage medium of claim 1, wherein to associate the billing data with the customer of the service provider network comprises to authenticate a validity of the billing data.

19. The system of claim 5, wherein to receive billing data generated by the software product comprises to receive the billing data at a billing service of the service provider network, the billing data identifying an amount to be charged, and the invoice is further based, at least in part, on the amount to be charged.

20. The computer-implemented method of claim 13, wherein receiving the billing data comprises receiving the billing data at a billing service of the service provider network, the billing data identifying an amount to be charged, and the invoice is further based, at least in part, on the amount to be charged.

* * * * *